US009637904B2

(12) United States Patent
Slothower et al.

(10) Patent No.: US 9,637,904 B2
(45) **Date of Patent: *May 2, 2017**

(54) MULTI-SPRAY BIDET

(71) Applicant: Kohler Co., Kohler, WI (US)

(72) Inventors: Erich D. Slothower, Mill Valley, CA (US); Qifeng Kuang, Shanghai (CN)

(73) Assignee: KOHLER CO., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/701,129

(22) Filed: Apr. 30, 2015

(65) Prior Publication Data

US 2015/0233105 A1 Aug. 20, 2015

Related U.S. Application Data

(63) Continuation of application No. 13/169,873, filed on Jun. 27, 2011, now Pat. No. 9,051,722.

(60) Provisional application No. 61/449,565, filed on Mar. 4, 2011.

(51) Int. Cl.
*E03D 9/08* (2006.01)

(52) U.S. Cl.
CPC ..... *E03D 9/085* (2013.01)

(58) Field of Classification Search
CPC ..... E03D 9/08; E03D 9/085
USPC ..... 4/420.1, 420.4, 420.5, 443–448; 239/448, 449, 609, 71, 74
See application file for complete search history.

(56) References Cited

U.S. PATENT DOCUMENTS

| | | | | |
|---|---|---|---|---|
| 4,406,025 | A | 9/1983 | Huck et al. | |
| 4,550,454 | A * | 11/1985 | Yui | E03D 9/08 239/461 |
| 4,553,274 | A | 11/1985 | Yui | |
| 5,101,520 | A * | 4/1992 | Lockhart | E03D 9/08 4/420.4 |
| 5,504,948 | A | 4/1996 | Chandler | |
| 7,913,329 | B2 | 3/2011 | Smith | |
| 8,321,969 | B2 * | 12/2012 | Jin | B05B 1/042 4/420.4 |
| 2005/0120470 | A1 | 6/2005 | Lim | |
| 2006/0207006 | A1 | 9/2006 | Koga et al. | |
| 2008/0142620 | A1 | 6/2008 | Scheidt et al. | |
| 2009/0077733 | A1 | 3/2009 | Jin | |
| 2009/0140075 | A1 | 6/2009 | Park et al. | |
| 2010/0269247 | A1 | 10/2010 | Chen | |

* cited by examiner

*Primary Examiner* — Erin Deery
(74) *Attorney, Agent, or Firm* — Foley & Lardner LLP

(57) ABSTRACT

A bidet includes one or more water sources, a generally elongate wand, and a spray head. The wand is configured to communicate water from the one or more water sources to the spray head. The spray head is configured to spray the water received from water sources, and the spray head is also configured to releasably couple to the wand by being received through an upper surface of the wand into a receptacle thereof.

20 Claims, 8 Drawing Sheets

MULTI-SPRAY BIDET

CROSS-REFERENCE TO RELATED PATENT APPLICATIONS

This application is a Continuation of U.S. patent application Ser. No. 13/169,873, filed Jun. 27, 2011, now U.S. Pat. No. 9,051,722, which claims the benefit of and priority to U.S. Provisional Patent Application No. 61/449,565, filed Mar. 4, 2011, the disclosures of which are incorporated by reference herein in their entirety.

BACKGROUND

The present disclosure pertains to bidets for use in bathroom applications. More particularly, the present disclosure relates to a spray wand and a spray head for a bidet.

Bidets typically include one or more sprayers configured to spray water for cleaning a portion of user's body. Each sprayer typically includes a spray head provided on a wand or arm. The spray head is connected to a water source in a manner that enables fluidic communication between the water source and the spray head. The wand is configured to move to active configurations, in which water may be sprayed for cleaning a user's body, such as to position the spray head under the user and/or angling the spray head toward the user. The wand may also be configured to move to an inactive configuration, in which the wand and spray head are positioned so as not to interfere with the user.

It would be advantageous to provide an improved spray wand and/or spray head for a bidet having features as described in the present application.

SUMMARY

According to an exemplary embodiment, a sprayer for a bidet includes a generally elongate wand and a spray head comprising a body portion and a head portion. The wand is configured to communicate water to the body portion of the spray head, the body portion of the spray head is configured to communicate the water to the head portion, and the head portion is configured to spray the water. The spray head is configured to releasably couple to the wand such that the head portion is centrally located relative to an upper surface of the wand.

According to another exemplary embodiment, a spray head for a bidet includes a body portion comprising a first port and a second port that generally surrounds the first port; and a head portion provided above the body portion. The head portion comprising a first nozzle group and a second nozzle group. The first nozzle group comprises one or more nozzles and the second nozzle group comprises one or more different nozzles from the first group. The first port is configured to communicate water to the first nozzle group and the second port is configured to communicate water to the second nozzle group According to another exemplary embodiment, a bidet includes one or more water sources, a generally elongate wand, and a spray head. The wand is configured to communicate water from the one or more water sources to the spray head, and wherein the spray head is configured to spray the water received from water sources. The spray head is configured to releasably couple to the wand by being received through an upper surface of the wand into a receptacle thereof.

DETAILED DESCRIPTION

Figure 1:
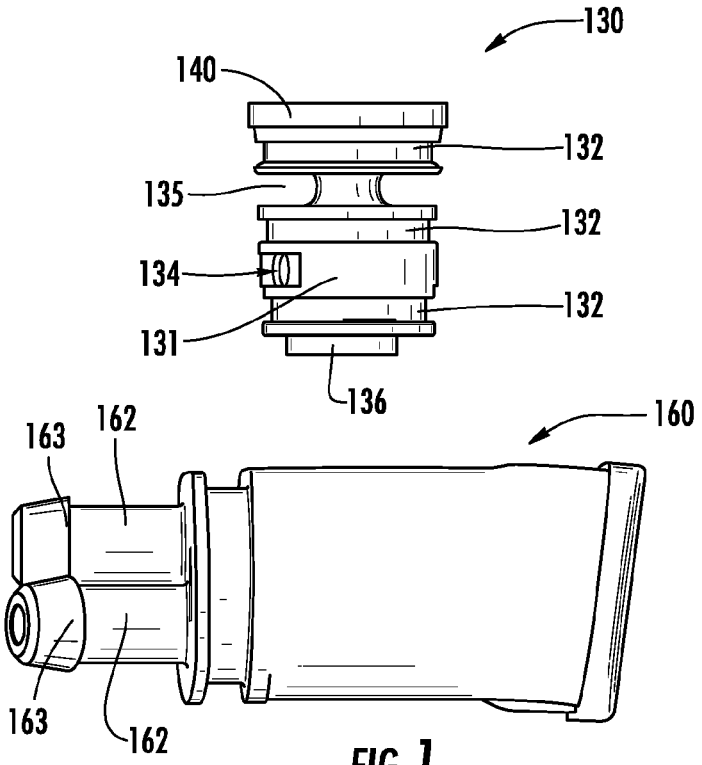
FIG. 1 is a side view of a spray head and receptacle according to an exemplary embodiment.
Figure 2:
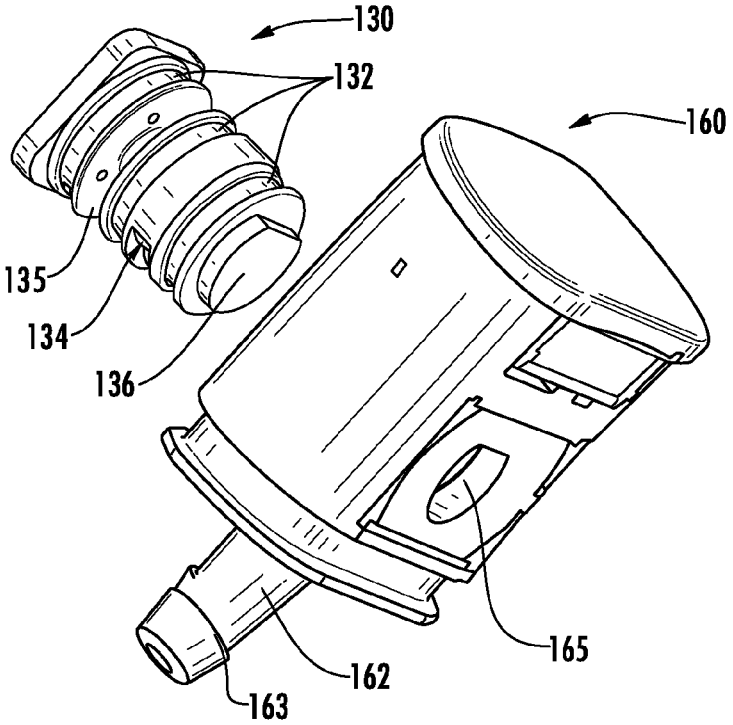
FIG. 2 is a perspective view of a spray head and receptacle according to an exemplary embodiment.
Figure 3:
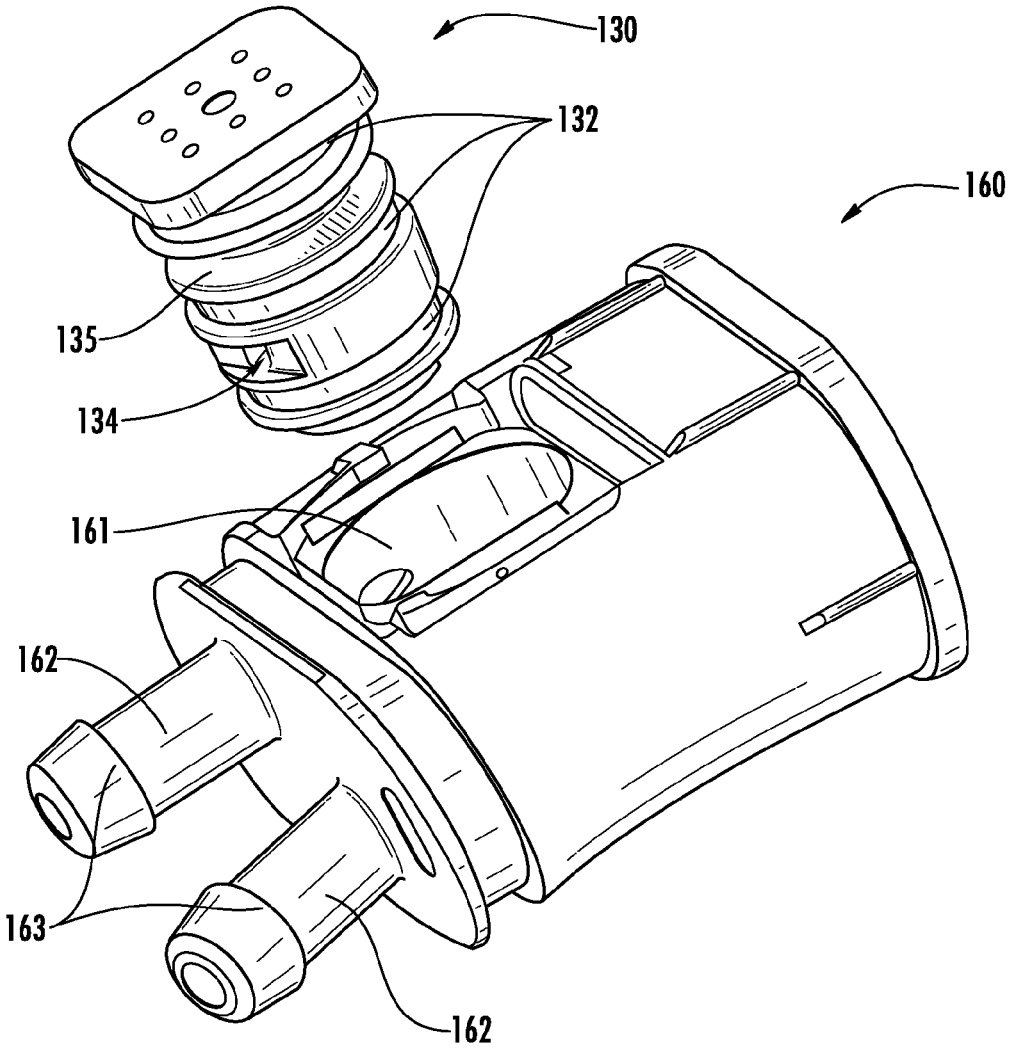
FIG. 3 is a perspective view of a spray head and receptacle according to an exemplary embodiment.
Figure 5:
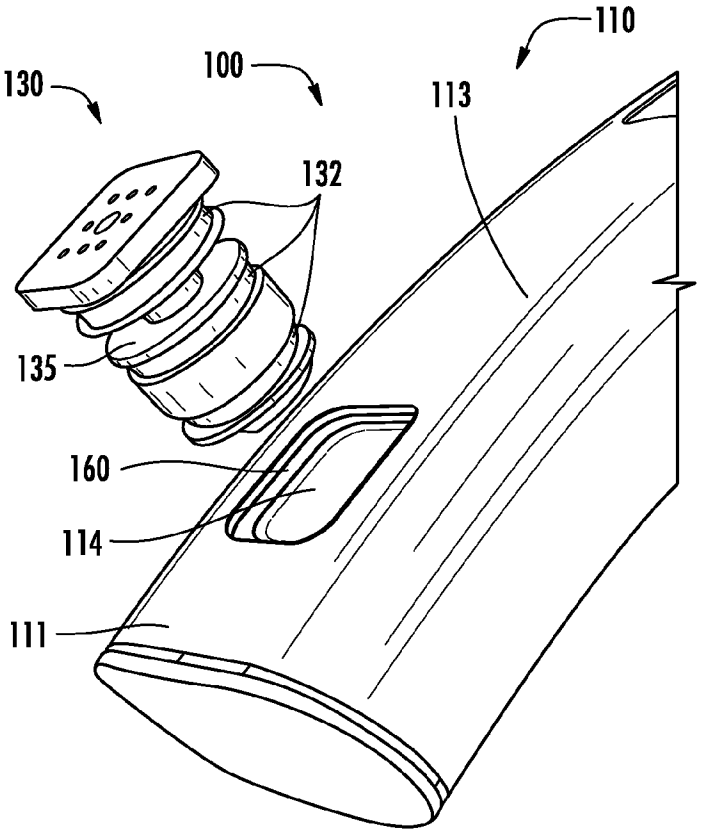
FIG. 5 is a perspective view of a spray head and assembled wand and receptacle according to an exemplary embodiment.
Figure 4:
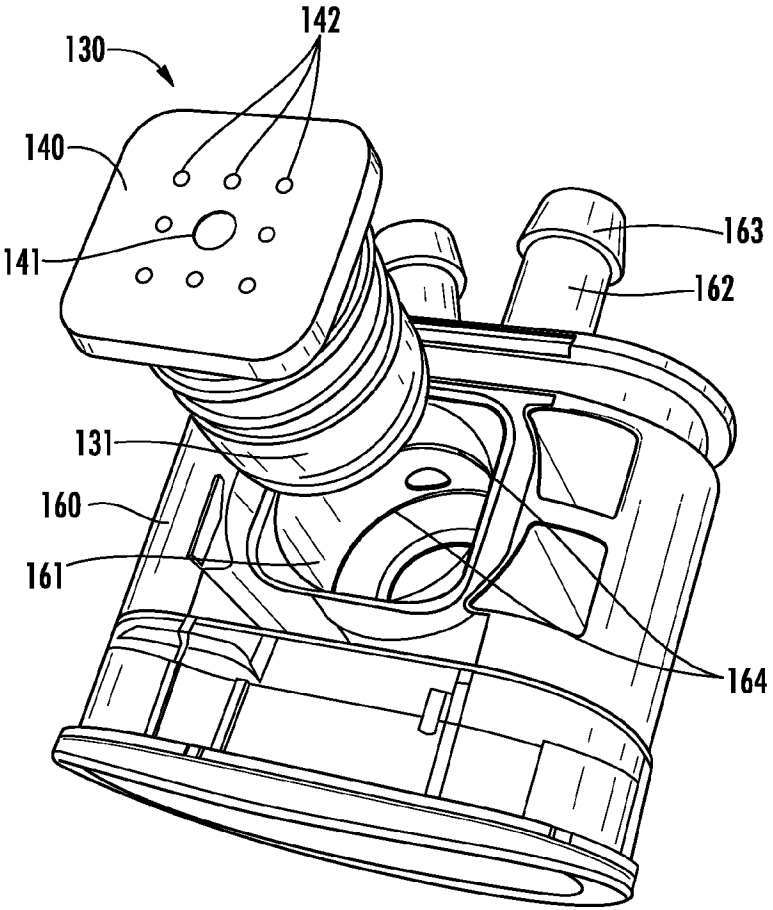
FIG. 4 is a perspective view of a spray head and receptacle according to an exemplary embodiment.
Figure 7:
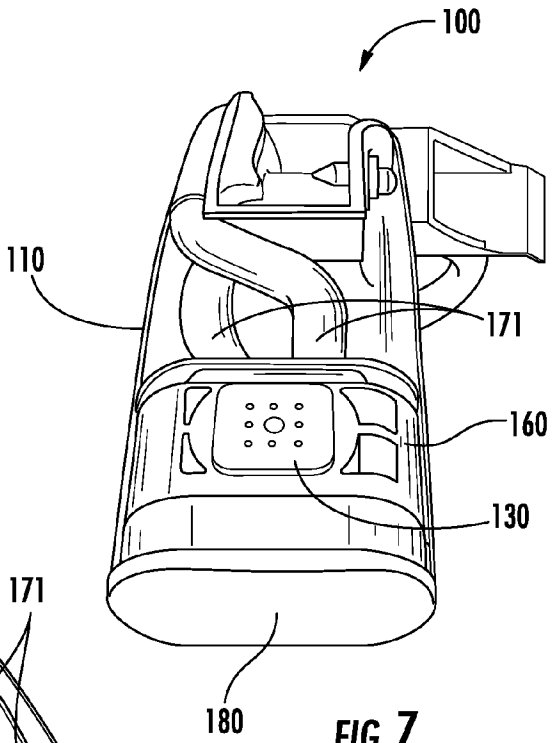
FIG. 7 is a front view of an assembled sprayer having a cut-away wand according to an exemplary embodiment.
Figure 6:
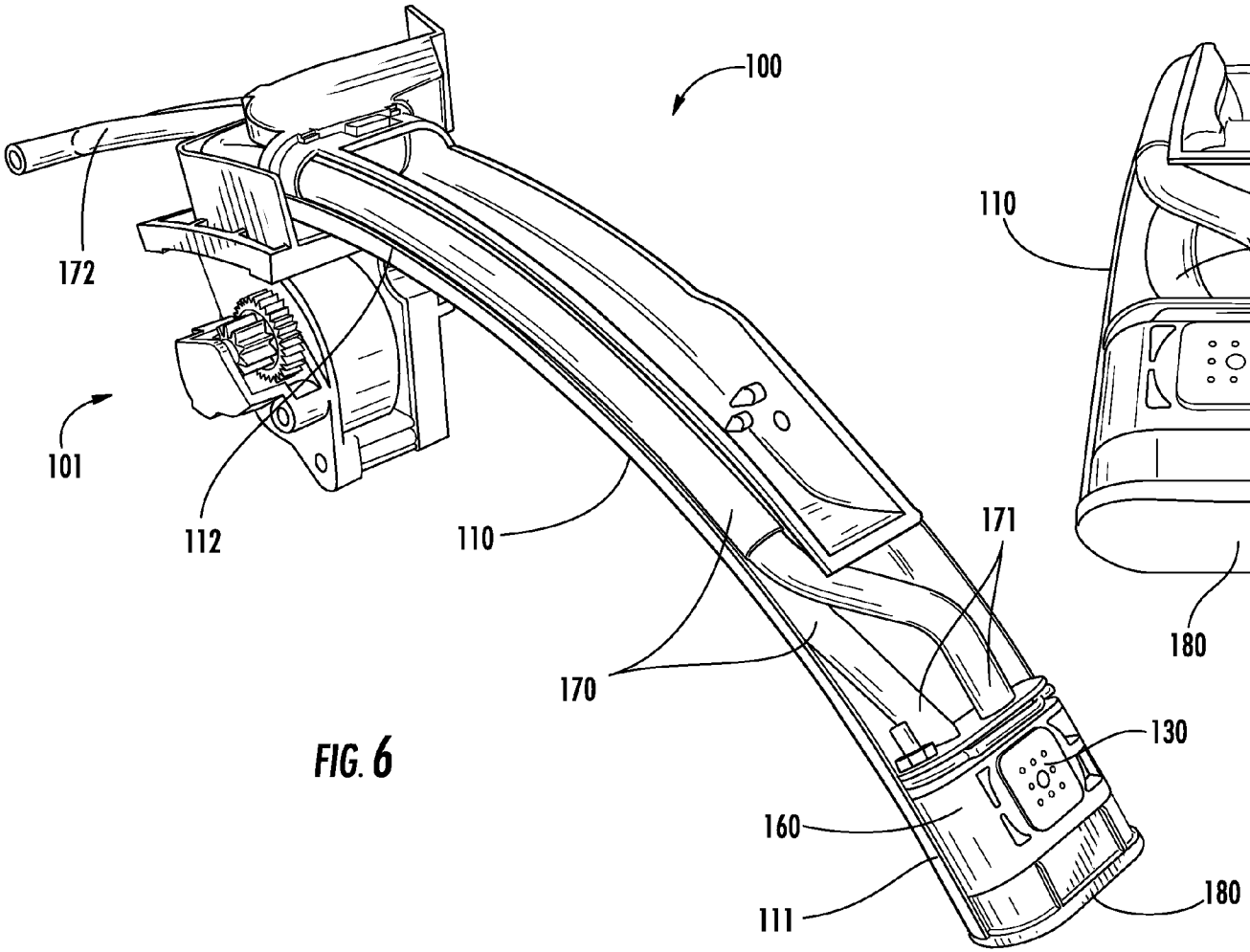
FIG. 6 is a perspective view of an assembled sprayer having a cut-away wand according to an exemplary embodiment.
Figure 9:
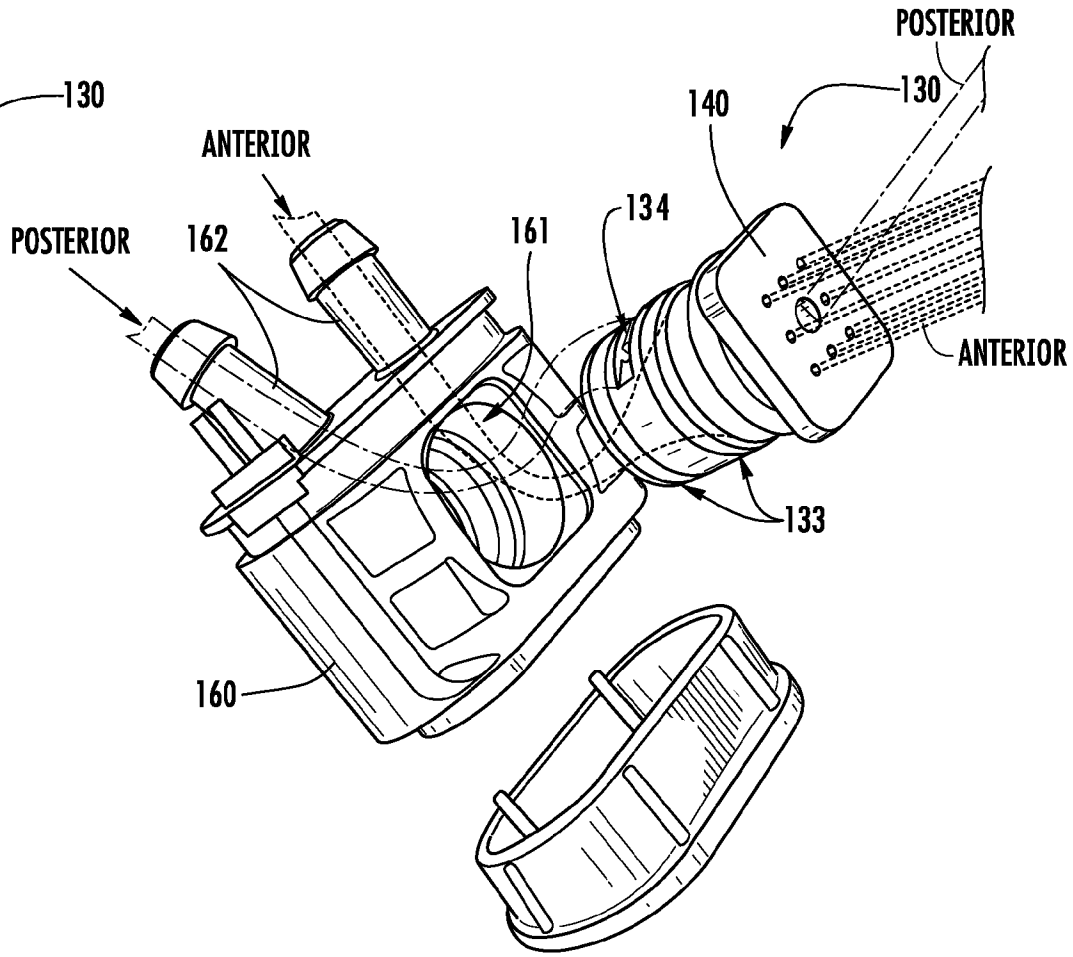
FIG. 9 is a perspective exploded view of a spray head and receptacle showing water flow according to an exemplary embodiment.
Figure 8:
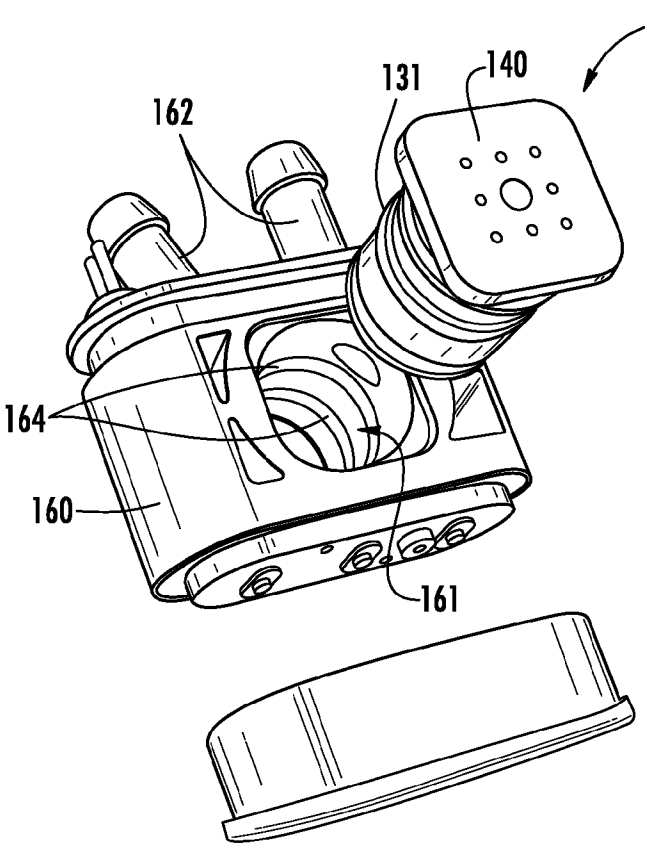
FIG. 8 is a perspective exploded view of a spray head and receptacle according to an exemplary embodiment.
Figure 10:
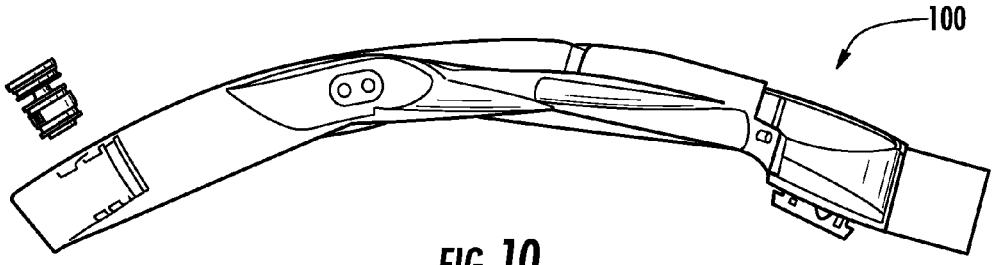
FIG. 10 is a side view of a sprayer according to an exemplary embodiment.
Figure 11:
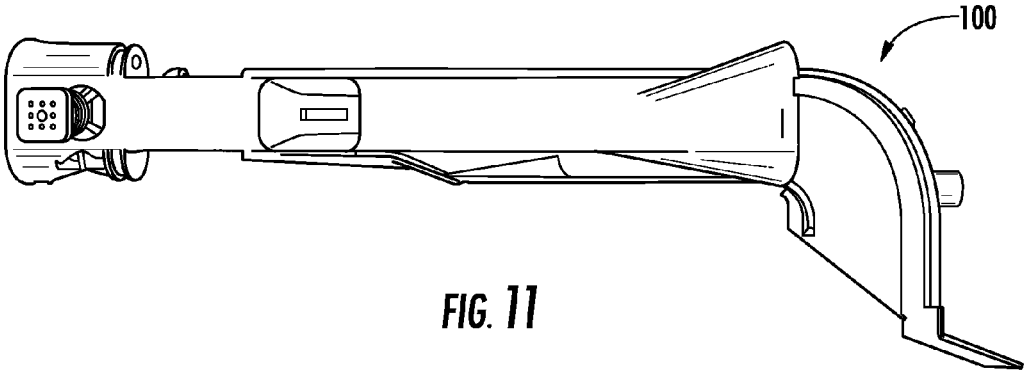
FIG. 11 is a top view of a sprayer according to an exemplary embodiment.
Figure 12:
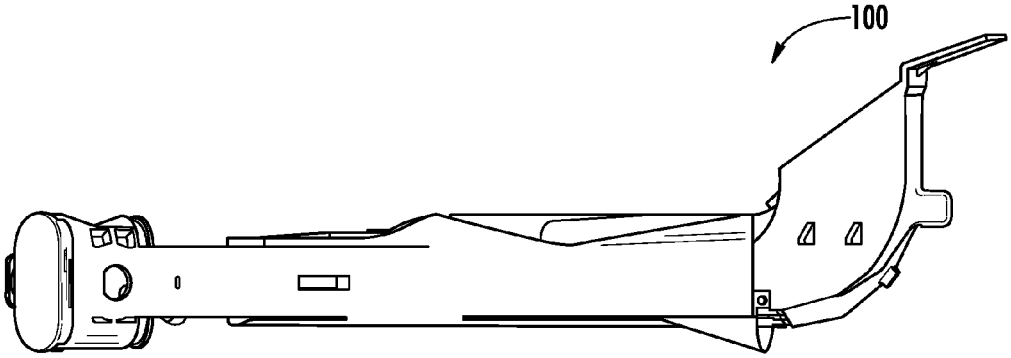
FIG. 12 is a bottom view of a sprayer according to an exemplary embodiment.
Figure 13:
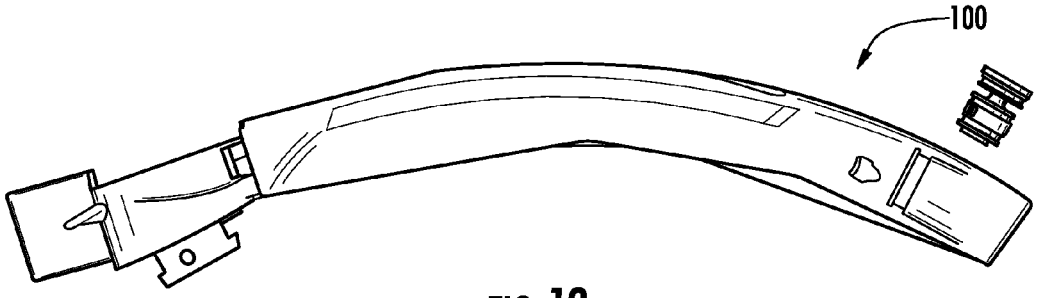
FIG. 13 is a side view of a sprayer according to an exemplary embodiment.
Figure 14:
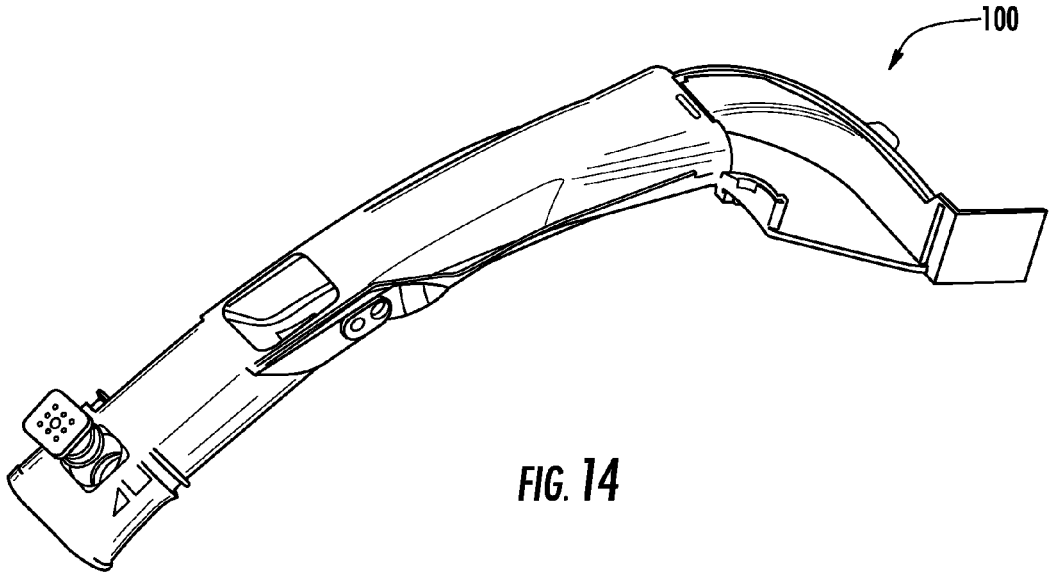
FIG. 14 is an perspective view of a sprayer according to an exemplary embodiment.
Figure 15:
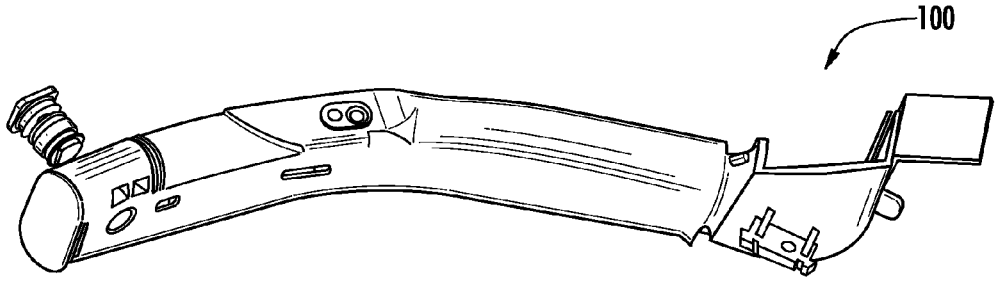
FIG. 15 is a perspective view of a sprayer according to an exemplary embodiment.
Figure 16:
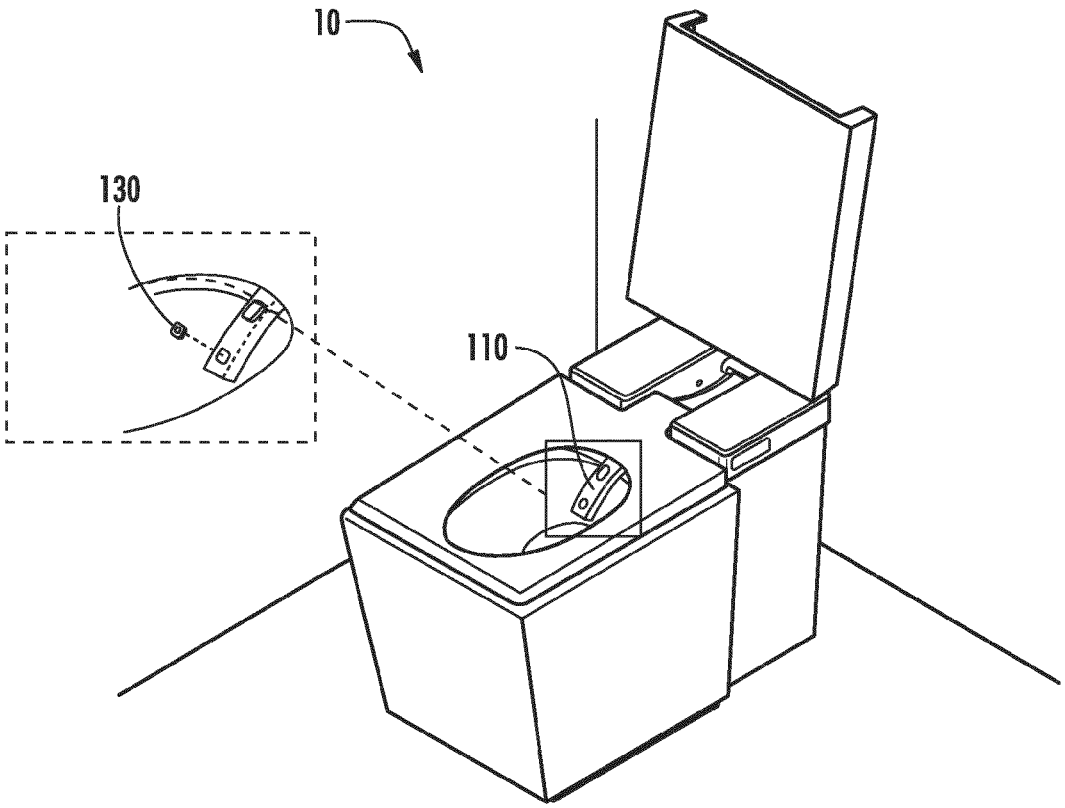
FIG. 16 is a perspective view of a bidet or toilet according to an exemplary embodiment, including a close-up view of a spray head and wand according to an exemplary embodiment.

Referring generally to the Figures, according to an exemplary embodiment, a bidet or toilet 10 includes a sprayer or spray assembly 100. The bidet sprayer 100 generally includes a wand or arm 110 and multi-spray spray head or tip 130 coupled to the wand 110. The wand 110 is configured to move the spray head 130 between one or more active configurations in which water may be sprayed for cleaning a user and an inactive or resting configuration. The spray head 130 includes two or more groups of nozzles 141, 142, which are selectively supplied with water from independently controlled water sources.

According to an exemplary embodiment, the wand 110 is a generally elongate, hollow member having a rearward end 112 and a forward end 111. The spray head 130 is centrally located relative to the wand 110, such as being disposed generally toward the forward end 111 and centered left to right. The wand 110 is configured to move the spray head 130 between active and inactive positions. In the inactive position, the wand 110 and spray head 130 are positioned so as not to interfere with the user. In the active positions, the wand 110 and spray head 130 are positioned and/or angled so as to spray water for cleaning the user. For example, a mechanism 101 may be provided that moves the wand 110 translationally, telescopically, rotationally, and/or any other manner to move or otherwise configure the wand between active and inactive configurations or positions. The wand 110 is a unitary, hydro-formed stainless steel component. According to other exemplary embodiments, the wand 110 is made from other materials (e.g., other metals or metal alloys, plastics, elastomers, composites, etc.), according to other manufacturing methods (e.g., extrusion, injection molding, etc.), in other configurations (e.g., multi-piece, etc.), with or without sanitary treatment (e.g., coatings, additives, other treatments for use in a bathroom, toilet, or bidet environment), and the like.

According to an exemplary embodiment, the bidet sprayer includes a receptacle 160. The receptacle 160 is a unitary, injection molded plastic piece configured to couple the spray head 130 to the wand 110 and to enable communication of water from one or more fluid sources to the spray head 130. The receptacle 160 is configured to couple to the wand 110, such as by interference fit or snap fit when pressed into the forward end 111 of the wand 110. The spray head 130 may also be configured to form a cap to cover a forward opening of the wand 110 at the forward end 111 and/or to receive a light and/or a lens 180. According to other exemplary embodiments, the receptacle 160 is made from other materials (e.g., metal, metal alloys, other plastics, composites, etc.), made according to other methods (e.g., blow molding, machining, etc.), and coupled to the wand 110 by other manners (e.g., snap fit, adhesives, integrally formed with the wand 110, removable or irremovable, etc.).

According to an exemplary embodiment, the receptacle 160 is configured to couple the spray head 130 to the wand 110. As discussed above, the receptacle 160 is coupled to or integrally formed with the forward end 111 of the wand 110. The receptacle 160 also includes a socket 161, which is a generally hollow and configured to receive and sealingly engage the spray head 130. Further details of the socket 161 and spray head 130 interaction are discussed in further detail below.

According to an exemplary embodiment, the receptacle 160 includes one or more inlets 162 configured to communicate water from water sources to the spray head 130. Each of the inlets 162 is a generally hollow, male member extending from an outer surface of the socket 161. Each inlet is configured to be received into and sealingly couple a forward end of one fluid tube, channel, or conduit 170. Each inlet, connector, or channel 162 may, for example, include a rib or tip 163, which is configured to form continuous contact around the periphery of the inlet 162 with the fluid tube 170, so as to form a seal and prevent decoupling of the inlet 162 and fluid tube 170. According to other exemplary embodiments, each inlet 162 and fluid tube 170 may be coupled in other manners including, for example, different male/female orientation, fittings, etc.

According to an exemplary embodiment, each fluid tube 170 is configured to communicate water from a water source (not shown) to the spray head 130 by way of the receptacle 160. While a forward end 171 of each fluid tube 170 is coupled to an inlet 162 of the receptacle 160, a rearward end 172 of each fluid tube 170 is coupled to, or otherwise in fluidic communication with, a water source. Each fluid tube 170 runs in a hollow portion of the wand 110 at least part way between the receptacle 160 and the rearward end 112 of the wand 110. Each fluid tube 170 may, for example, be an extruded polypropylene material. According to other exemplary embodiments, each fluid tube 170 may be made from other materials (e.g., metal, metal alloys, composites, elastomeric materials, other plastics, etc.), may be made according to other manufacturing methods (e.g., injection molding, blow molding), may be formed integrally with the wand 110, and the like.

According to an exemplary embodiment, the bidet includes one or more water sources configured to selectively supply water to the spray head 130. The one or more water sources are further configured to selectively and independently supply to the first and second nozzle groups 141, 142, such that water may be supplied to neither, either, or both of the nozzle groups 141, 142. Water may be supplied to the first and second nozzle groups 141, 142 sequentially and/or simultaneously. For example, each water source may use a combination of one or more valves and/or one or more pumps to selectively control water temperature, pressure, flow rate, and/or pattern (e.g., pulsating, oscillating, or waving whether controlled by water sources, move the wand 110 with the mechanism 101, and/or a combination thereof). According to one exemplary embodiment, each water source selectively supplies water to only one fluid tube 170 and, hence, only one nozzle group (e.g., 141, or 142). According to other exemplary embodiments, each water source may selectively and independently supply water to more than one fluid tube 170 and, hence, first and second nozzle groups 141, 142 by controlling output valves or other devices sufficient to selectively and independent control water flow.

According to an exemplary embodiment, the spray head 130 is configured to receive water from each fluid tube 170 and direct (e.g., spray) water toward the user in different manners, such as to clean the user. The spray head 130 generally includes a body portion 131 and a head portion 140. The body portion 131 is configured to couple to the receptacle 160 and communicate water to the head portion 140. The head portion 140 includes two or more groups 141, 142 of distinct nozzles.

According to an exemplary embodiment, the spray head 130 is a unitary, machined or milled stainless steel piece. According to other exemplary embodiments, the spray head 130 is made from other materials (e.g., metal, other metal alloys, composites, polymers, whether untreated or treated for sanitary purposes), is made according to other manufacturing methods (e.g., casting, injection molding, blow molding, etc.), or is made from multiple components of the same or different materials and/or manufacturing methods.

According to an exemplary embodiment, the body portion 131 is configured to releasably couple to the socket 161 of the receptacle 160. The body portion 131 is a generally cylindrical member having a diameter that is slightly smaller than the socket 161, such that the body portion 131 may be inserted into the socket 161. The body portion 131 includes one or more slots or indentations 132 extending around the outer periphery of the body portion 131 and configured to receive O-rings or other gaskets 133. The receptacle 160 includes corresponding slots and/or an interior peripheral surface. The O-rings or gaskets 133 are configured to maintain continuous contact with both the body portion 131 and socket 161 so as to be compressed therebetween and form a seal. Further, the slots 132 on the socket 161 cooperate with the gaskets 133 so as to retain the body portion 131 of the spray head 130 in the receptacle 160.

According to an exemplary embodiment, the spray head 130, receptacle 160, and/or wand 110 are configured such that the spray head 130 may be easily removed for replacement or servicing. For example, the spray head 130 may be configured to pop into and/or out of a central aperture defined by the receptacle 160 and/or wand 110. The receptacle 160 includes a cutout 165 disposed toward a generally bottom portion of the receptacle 160. The wand 110 also includes a cutout, which is disposed proximate the cutout 165 of the receptacle 160. The spray head 130 includes a bottom portion 136 that is configured to be disposed into the cutout 165 of the receptacle 160 and/or the wand 110. By providing bottom cutouts in the receptacle 160 and wand 110, a user or servicer may remove the spray head 130 by applying an upward force against the bottom portion 136 of the spray head 130, such as with a finger or instrument. Further, the bottom portion 136 of the spray head 130 and the cutout 165 of the receptacle and/or the cutout of the wand 110 may be shaped so as to ensure proper alignment and prevent relative rotation of the spray head 130 relative to the receptacle 160 and wand 110.

According to other exemplary embodiments, the spray head 130, receptacle 160, and/or wand 110 are configured in other manners for releasably coupling the spray head 130. For example by a threaded, latch, bayonette-type (e.g., push button release), partial turn (e.g., quarter-turn), spring-type, or snap-type coupling.

According to an exemplary embodiment, the head portion 140 of the spray head 130 is configured to mount flush, flat, or even with an upper surface 113 of the wand 110. The wand 110 includes an aperture or cutout 114 on the upper surface 113 of corresponding shape and size to receive the head portion 140 with minimal gap between the wand 110 and head portion. The head portion 140 and receptacle 160 are also configured with corresponding thickness and height such that the head portion 140 is flush with the upper surface of the wand 110. According to other exemplary embodiments, the head portion 140, wand 110, and receptacle 160 may be configured in other manners including, but not limited to, surface mount of the head portion 140 on top of the upper surface of the wand, providing a recess (rather than a cutout) in the upper surface of the wand 110 with corresponding depth to head portion 140 height for a flush fit, and the like.

According to an exemplary embodiment, the body portion 131 is configured to receive water from each fluid tube 170 for communication to the nozzle groups 141, 142. The body portion 131 includes a lower port 134 and an upper port 135. The lower port 134 is a generally cylindrical aperture that extends into the body portion 131. The lower port 134 connects to a central, vertical channel that leads to a first nozzle group 141. The lower port 134 may also include a cutout that, collectively with the interior surface of the socket 161, forms a chamber for receiving water from one of the fluid tubes 170 and/or inlet 162 before communicating water to the first nozzle group 141. The upper port 135 is generally a horizontal channel that runs around the vertical channel and extends to the periphery of the body portion 131. The upper port 135, collectively with the interior surface of the socket 161, forms a chamber for receiving water from one of the fluid tubes 170 and communicating water to the second nozzle group 142. According to other exemplary embodiments, the body portion 131 may be configured in other manners including, for example, a different number of ports (e.g., one or more than two), different port shape (e.g., channels, cylindrical aperture, etc.), different port orientation (e.g., side-by-side, staggered, etc.), different communication (e.g., channel, chamber, etc.).

According to an exemplary embodiment, the respective slots 132 of the body portion 131, slots or indentations 164 of the socket 161, and gaskets 133 are configured to prevent leaking from the spray head 130 and to prevent mixing of water between the first and second nozzle groups 141, 142. The slots 132 of the body portion 131 are configured to receive the gaskets 133. An upper slot 132 is disposed below the lower port 134, a middle slot 132 is disposed between the lower port 134 and upper port 135, and an upper slot 132 is disposed above the upper port 135. The socket 161 provides either a corresponding slot 164 or a surface for each gasket 133 to mate against. For example, the socket 161 includes a lower slot 164 that corresponds to the lower slot 132 of the body portion 131 to receive the gasket 133. The socket includes a middle slot 164 that corresponds to the middle slot 132 of the body portion 131 to receive the gasket 133. The socket includes an upper surface that corresponds to the upper slot 132 of the body portion 131 for mating against the gasket 133. According to other exemplary embodiments, the slots, surface, and/or gaskets may be configured in other manners including, for example, different number (e.g., more or fewer slots, surface, and/or gaskets), different shape (e.g., slots that do not extend entirely around the body portion 131 and/or socket 161), different gaskets (e.g., other types of seals, seals/gaskets molded to the body portion 131 and/or socket 161, seals/gaskets formed integrally with the body portion 131 and/or socket 161, etc.), different position (e.g., for forming seals between bottom and/or upper portions of the body portion 131 and/or socket 161), etc.

According to an exemplary embodiment, the head portion 140 of the spray head 130 includes first and second nozzle groups 141, 142 configured to direct or spray water from different sources in different manners. The first nozzle group 141 may, for example, include one nozzle in fluidic communication with the lower-port of the body and the first water source. The nozzle of the first nozzle group is centrally located on the head portion 140 of the spray head 130 and is configured to direct or spray water in a single stream toward a posterior portion of the user. The second nozzle group 142 may, for example, include individual eight nozzles disposed around the nozzle of the first group. The nozzles of the second nozzle group 142 are in fluidic communication with the second water source. The nozzles of the second nozzle group 142 are configured to direct or spray water in multiple streams toward an anterior portion of the user. For example, the nozzles may be holes, drilled or otherwise provided, protruding through an upper surface of the head portion 140 to the channels connecting to the lower and upper ports 134, 135. The nozzles may further be configured to direct water in desired directions from the head portion, such as by providing holes at different angles relative to the surface of the head portion, providing nozzle inserts, etc. According to other exemplary embodiments, the head portion 140 of the spray head 130 is configured in different manners including, for example, more or fewer nozzle groups (e.g., one or more than two), nozzle groups having more or fewer nozzles (e.g., one to seven nozzles, or more than nine nozzles), direct water in different directions (e.g., multiple nozzle groups being directed toward anterior or posterior portions of a user, one of the nozzle groups being directed toward other portions of a user), and the like.

According to an exemplary embodiment, the sprayer 100 may also include other features, such as an air duct and temperature sensor for a blower and lighting and/or fiber optics, such as for being turned on when in an inactive position. Further, the foregoing designs provides for enhanced design aesthetics by utilizing stainless steel or other relatively strong materials to allow for a minimalist design, by providing a flush fit between a centrally-located spray head and wand, etc.

According to an exemplary embodiment, the sprayer 100 is assembled by first inserting or otherwise coupling the receptacle 160 to the wand 110 toward the forward end 111 of the wand 111. The fluid tubes 170 are then coupled to the inlets 162 of the socket 160. The wand 110 and fluid tubes 170 may then be coupled to other portions of the bidet, such as the water sources and/or the movement mechanism 101. The spray head 130 is then inserted into the socket 161 of the receptacle 160 through the cutout in the supper surface of the wand 110. According to other exemplary embodiments, the bidet or sprayer 100 may be assembled according to any other suitable assembly method including, for example, assembling the components in a different order.

According to an exemplary embodiment, the sprayer 100 is operated by moving or otherwise configuring the sprayer 100, such as with the mechanism 101, into an active position or configuration from an inactive position or configuration. For example, the wand 110 may be moved rotationally, translationally, and/or telescopically so as to position or otherwise configure the spray head 160 for cleaning the user. The water sources may then be configured so as to supply water through one or more of the fluid tubes 170 and the first and/or second nozzle groups 141, 142 to the user. The water sources may further supply water in different manners characterized by, for example, temperature, pressure, flow rate, flow pattern (e.g. pulsing, steady, varying pressure, etc.), and the like. The wand 110 may also be moved in various patterns while water is supplied by the water sources to the first and/or second nozzle groups 141, 142. The one or more waters source and/or wand 110 may also be positioned and/or otherwise configured for cleaning the spray head 130, such as by forcing water at high pressure through the first and/or second nozzle groups and/or causing water to be sprayed over the top of the spray head 130, such as by deflecting water from the spray head 130 off a surface positioned above the spray head 130.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the dual gear assemblies as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A sprayer for a bidet, comprising:

a wand comprising an aperture defined by an upper surface of the wand, the aperture extending to a cutout defined by a lower surface of the wand; and a spray head comprising a body portion, a head portion, and a bottom portion;

wherein the wand is configured to communicate a flow of water to the body portion, the body portion is configured to communicate the flow of water to the head portion, and the head portion is configured to spray the flow of water;

wherein the spray head is configured to be received within the aperture and to releasably couple to the wand;

wherein the lower surface includes an inner edge defining the cutout; and wherein the bottom portion of the spray head is configured to engage at least a portion of the inner edge to rotationally fix and rotationally align the spray head relative to the wand so as to prevent relative movement between the spray head and the wand.

2. The sprayer of claim 1, wherein the inner edge includes a curved portion and a straight portion, and wherein the bottom portion includes a peripheral edge that is complementary to the inner edge such that the bottom portion is received within the cutout.

3. The sprayer of claim 2, wherein the spray head is configured to releasably couple to the wand, the body portion being insertable through the aperture in the upper surface of the wand.

4. The sprayer of claim 3, wherein the wand comprises a receptacle configured to releasably couple to the spray head, and wherein the receptacle is configured to receive the body portion of the spray head and is configured to communicate water from one or more water sources to the spray head.

5. The sprayer of claim 4, wherein:

the body portion of the spray head comprises one or more slots extending around the periphery of the body portion and a gasket disposed in each of the one or more slots;

the receptacle includes one or more slots or surfaces, each slot or surface configured to be in alignment with one of the one or more slots of the body portion of the spray head; and a seal is formed by each gasket between the slot of the body portion and the aligned slot or surface of the receptacle, such that the water is prevented from leaking and the body portion of the spray head is retained within the receptacle.

6. The sprayer of claim 1, wherein the head portion of the spray head comprises a first group of one or more nozzles and a second group of one or more nozzles, wherein the second group of one or more nozzles are different from the one or more nozzles of the first group.

7. The sprayer of claim 6, wherein the one or more nozzles of the first group are configured to spray water toward an anterior portion of a user, and the one or more nozzles of the second group are configured to spray water toward a posterior portion of the user.

8. The sprayer of claim 6, wherein the one or more nozzles of the first group are configured to receive water from a first water source and the one or more nozzles of the second group are configured to receive water from a second water source different from the first water source.

9. The sprayer of claim 8, wherein at least one of the flow rate, temperature, pressure, or flow pattern of the first water source and the second water source is capable of being independently controlled.

10. The sprayer of claim 1, wherein at least one of the wand or the spray head is composed at least in part of stainless steel.

11. The sprayer of claim 1, wherein the upper surface of the wand is flush with the head portion of the spray head.

12. A spray head for a bidet, comprising:

a body portion comprising a first port and a second port that generally surrounds the first port;

a head portion provided above the body portion, the head portion comprising a first nozzle group and a second nozzle group, wherein the first nozzle group comprises one or more nozzles and the second nozzle group comprises one or more nozzles that are different from the one or more nozzles of the first nozzle group;

a bottom portion provided below the body portion for both rotationally aligning and rotationally fixing the spray head relative to the bidet so as to prevent relative movement between the spray head and the bidet;

wherein the first port is configured to selectively communicate water from a first water source to the first nozzle group and the second port is configured to selectively communicate water from a second water source to the second nozzle group.

13. The spray head of claim 12, wherein at least a portion of the second port is disposed above at least a portion of the first port, wherein the first port includes a generally vertical channel, and wherein the second port includes a generally horizontal channel that extends around the generally vertical channel of the first port.

14. The spray head of claim 13, wherein the spray head is configured to releasably couple to a bidet wand, wherein the second port is configured to form an upper chamber collectively with the wand, and wherein the upper chamber generally surrounds the generally vertical channel of the first port.

15. The spray head of claim 14, wherein the first port is configured to form a lower chamber collectively with the wand, and wherein the lower chamber is disposed generally below the upper chamber.

16. The spray head of claim 12, wherein the one or more nozzles of the first nozzle group are centrally located on an upper surface of the spray head, and wherein the second nozzle group comprises a plurality of nozzles disposed around the one or more nozzles of the first nozzle group on the upper surface of the spray head.

17. The spray head of claim 16, wherein the first port includes a generally vertical channel and the second port includes a generally horizontal channel that extends around the generally vertical channel; and wherein one or more nozzles of the first nozzle group are holes that extend through the upper surface of the spray head to the generally vertical channel, and the plurality of nozzles of the second nozzle group are holes that extend through the upper surface of the spray head to the generally horizontal channel.

18. A bidet, comprising:

a generally elongate wand comprising an aperture defined by an upper surface of the wand extending to a cutout defined by a lower surface of the wand; and a spray head comprising a body portion, a head portion, and a bottom portion;

wherein the wand is configured to communicate water from one or more water sources to the spray head;

wherein the spray head is configured to spray the water received from the one or more water sources;

wherein the spray head is configured to releasably couple to the wand by being received through the aperture into a receptacle of the wand such that the bottom portion is at least partially disposed in the cutout; and wherein the cutout is defined by an edge of the lower surface, the edge is configured to engage a peripheral edge of the bottom portion to rotationally align and rotationally fix the spray head relative to the wand so as to prevent relative movement between the spray head and the wand.

19. The bidet of claim 18, wherein the edge of the lower surface includes a curved portion and a straight portion, and wherein the bottom portion of the spray head has an outer shape that is complementary to the edge.

20. The bidet of claim 19, wherein the head portion comprises a first nozzle group of one or more nozzles generally centered on the head portion and a second nozzle group of a plurality of nozzles disposed generally around the one or more nozzles of the first nozzle group;

wherein the body portion comprises a first port configured to receive water from a first water source and communicate the water to the first nozzle group; and wherein the body portion comprises a second port disposed generally above the first port, the second port configured to receive water from a second water source and communicate the water to the second nozzle group.

* * * * *